United States Patent [19]

Baader

[11] 4,346,276

[45] Aug. 24, 1982

[54] MULTIPLE PRESSURE SWITCH

[76] Inventor: Helmut Baader, Birkenweg 6, D-8470 Nabburg, Fed. Rep. of Germany

[21] Appl. No.: 214,948

[22] Filed: Dec. 10, 1980

[51] Int. Cl.[3] ..... H01H 13/00

[52] U.S. Cl. ..... 200/329; 200/153 T; 200/67 C; 200/159 B; 200/67 DA

[58] Field of Search ..... 200/329, 340, 153 T, 200/67 DA, 67 D, 67 B, 159 B, 9, 6 A, 67 C

[56] References Cited

U.S. PATENT DOCUMENTS

| | | | |
|---|---|---|---|
| 2,401,213 | 5/1946 | Wood | 200/329 |
| 2,542,533 | 2/1951 | Johansson | 200/329 |
| 2,954,447 | 9/1960 | Bolesky et al. | 200/67 DA |
| 3,057,982 | 10/1962 | Grover et al. | 200/67 DA |
| 3,105,130 | 9/1963 | Weiford | 200/153 T |
| 3,210,486 | 10/1965 | Holzer | 200/18 |

FOREIGN PATENT DOCUMENTS

| | | | |
|---|---|---|---|
| 1939186 | 2/1966 | Fed. Rep. of Germany . | |
| 1280962 | 10/1968 | Fed. Rep. of Germany . | |
| 1143894 | 10/1971 | Fed. Rep. of Germany . | |
| 2311498 | 5/1975 | Fed. Rep. of Germany . | |
| 211116 | 7/1966 | Sweden | 200/153 T |

*Primary Examiner*—Willis Little

*Attorney, Agent, or Firm*—Karl W. Flocks; A. Fred Starobin

[57] ABSTRACT

A multiple pressure switch comprising a first and a second snap switch, which under spring pre-stress each assume a starting position and have a first and second point of application respectively for an actuating member, which is supported on a total of three application points lying on the corners of a conceived triangle, and with gradual increase of an external force acting on the actuating member within the triangle causes first the first and then the second snap switch to snap over into a final position. Relative to a base plane normal to the direction of application of the external force the first point of application in its starting position lies higher and in its end position lies deeper then the second point of application in its original position, and the second point of application in its starting position lies higher and in its end position lies lower than the third point of application.

5 Claims, 8 Drawing Figures

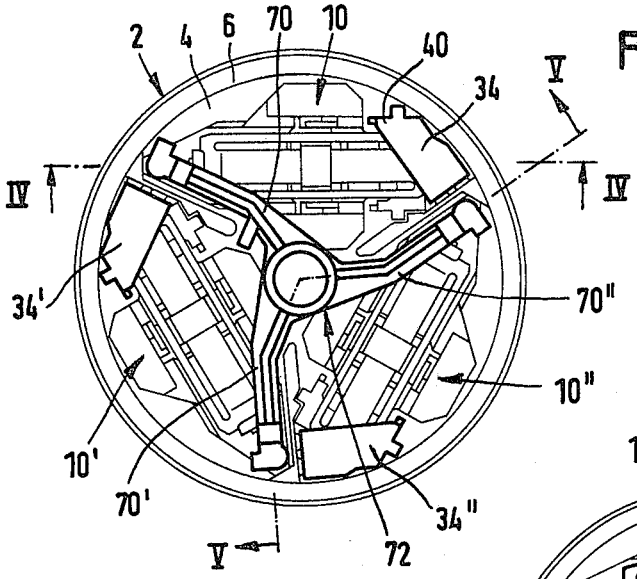
FIG. 1
FIG. 2
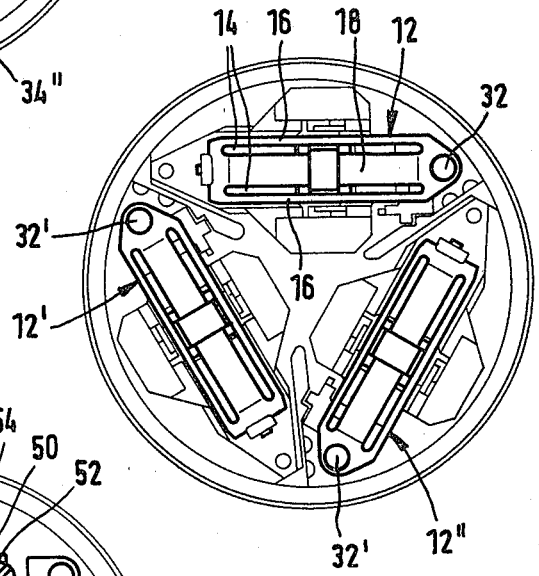
FIG. 3
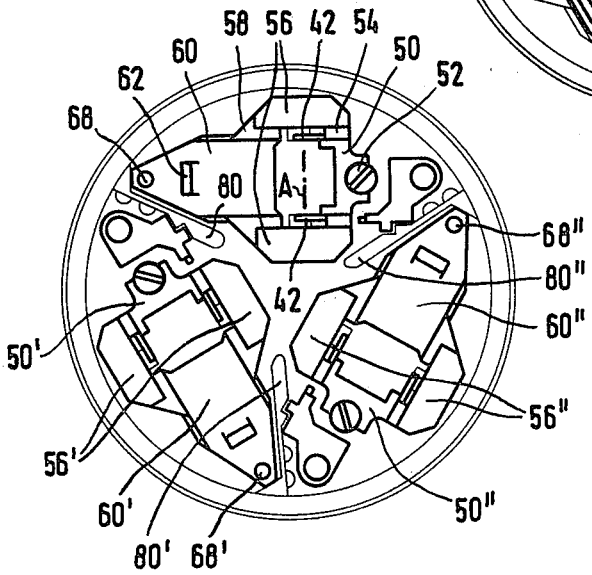

MULTIPLE PRESSURE SWITCH

BACKGROUND OF THE INVENTION

The present invention concerns a multiple pressure switch comprising a first and a second snap switch, which under spring prestress each assume a starting position and have a first and second point of application, respectively, for an actuating member, which is supported on a total of three application points lying on the corners of a conceived triangle, and with gradual increase of an external force acting on the actuating member within said triangle causes first the first and then the second snap switch to snap over into a final position.

In general, such multiple pressure switches have a housing, which is subdivided into two chambers by a membrane. A pressure to be monitored is effective on one side of the membrane. A pressure plate is arranged on the other side of the membrane, onto which the membrane transmits the pressure and which for its part is supported on said actuating member. The actuating member is generally designed as a three-armed lever and extends to one of the points of application with each of its three arms. The points of application lie on the corners of a triangle, preferably an equilateral triangle. The pressure plate is preferably supported in the center of this triangle on the actuating member. At least two of the application points for the actuating member are formed on one of the snap switches each. The third point of application is either stationary or, if a three-fold switching over possibility is required, it is formed on a third snap switch. If, proceeding on the basis of a state of rest, in which the membrane is not loaded with a pressure, the external pressure acting upon the membrane, and thus the external force acting upon the actuating member, gradually increases, and finally reaches an amount predetermined by the prestress on the first snap switch, then the first snap switch snaps, as corresponds to the essence of a snap switch, out of its original position abruptly into its final position. The actating member follows the first point of application, in that it swivels about a conceived axis, which is determined by the second and the third point of application. The point of the actuating member, which originally lay on the first point of application, moves along an arc with this swivelling of the actuating member. In general, for reasons of space, it is not possible to arrange the first snap switch in such a way that its point of application moves along the same arc when snapping over. Consequently, when the first snap switch snaps, over a relative shift takes place between the first point of application and the actuating member, in which case a frictional resistance must be overcome. This frictional resistance cannot be kept sufficiently constant in series production, and changes in the course of time due to the fact that the mostly small surfaces slipping over each other either become smoother, when the respective snap switch snaps over frequently, or they gradually become rougher by corrosion. At a given magnitude of the frictional force, the greater the relative shift between the point of application and the actuating member, the greater is the energy consumed by friction.

What has been stated in the foregoing in connection with the first snap switch applies analogously for the second snap switch when it snaps over, as well as for the third snap switch, if any. However, the greater the frictional energy consumed with snapping over of the individual snap switches due to relative shift between their point of application and the actuating member, the smaller is the accuracy with which a certain switchover pressure can be predetermined for each snap switch by adjusting the spring prestress of the respective snap switch.

SUMMARY OF THE INVENTION

It is an object of the present invention, with a multiple pressure switch of the type described at the outset, to reduce the influence which friction between the actuating member and the individual snap switches exerts on switchover accuracy compared to known switches of the same type.

According to the invention, this object is met in that relative to a base plane normal to the direction of application of said external force, the first point of application in its starting position lies higher and its final position lies lower than the second point of application in its original position, and that the second point of application lies higher in its original position and lower in its final position than the third point of application.

In this manner, the relative shift, which takes place between the individual points of application and the actuating member with snapping over of any one of said snap switches can be kept much smaller than in the case of the described known multiple pressure switches.

The smallest possible relative shift at a given size of the switching path and a given distance between the points of application with snapping over of the first snap switch is achieved when the second point of application in its original position lies at half height between the original and final position of the first point of application.

In a corresponding manner, under otherwise the same conditions, one achieves the smallest possible relative shift with the snapping over of the second snap switch, when the first point of application in its final position lies at half height between the starting and end position of the second point of application.

The third point of application can be stationary in a known manner, if only two snap switches are required. However, the invention is applicable also to triple-pressure switches with special advantage, therefore to those pressure switches which in addition to the first and second snap switches have a third snap switch, on which the third point of application for the actuating member is formed, and which on gradual increase of the external force, snaps over after the second snap switch. According to the present invention, such a multiple pressure switch is developed further in such a way that the third point of application lies deeper in its final position than the second point of application in its final position.

The smallest possible relative shift between the snap switches and the actuating member with switching over of the third snap switch results when the second point of application in its end position lies at half height between the starting and end position of the third point of application.

BRIEF DESCRIPTION OF THE DRAWINGS

An embodiment of the invention will be explained more closely in the following on the basis of schematic drawings.

FIGS. 1 to 3 show top views of a triple pressure switch in different states of increasing disassembly.

DESCRIPTION OF THE PREFERRED EMBODIMENT

Figure 4:
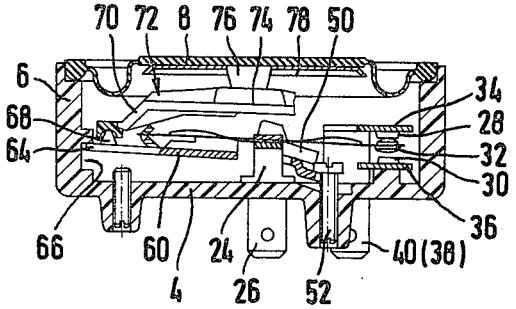
FIG. 4 shows the cross section IV—IV in FIG. 1.

The shown triple pressure switch has a jar-shaped housing 2 with an essentially plane base 4 and a circular-cylindrical outer wall 6. The housing 2 is closed off by a membrane 8, which in the finished assembled triple pressure switch is covered over by a not shown housing cover and is tightly clamped between this and the housing 2.

The housing 2 contains three snap switches 10,10' and 10'', which fully resemble each other in design and differ from each other only in their arrangement within the housing 2. Therefore, only the snap switch 10 will be individually described. The constructional parts of the two other snap switches 10' and 10'' are provided with the same reference numerals as the corresponding constructional parts of snap switch 10 and are distinguished from these by a single or a double stroke according to whether they belong to snap switch 10' or 10''.

As a movable, electrically conductive constructional part, the snap switch 10 has a snap spring 12 in the shape of a rectangular leaf spring. The snap spring 12 has two parallel lengthwise slits 14, which define a pair of outer legs 16 in such a way that these are interconnected only at both their ends and by a middle part of the snap spring 12. The middle part consists of two middle legs 18, which are separated from each other. Both these middle legs 18 are welded to a spring support 24 in such a way that the total length of the middle legs 18 and of the section of the spring support 24 connecting them with each other is greater than the length of each of the two outer legs 16.

Consequently, both middle legs 18 cannot lie in a common plane with the outer legs 16, but form either an upward arched wiggle with respect to the outer legs 16, then downward arched and finally again upward arched wiggle (FIG. 4) or an upward arch with respect to both outer legs 16. The snap spring 12 fastened on the spring support 24 is thus bistable. It can spring back and forth between a first switching position (FIG. 4) and a second switching position under the effect of an outer force only.

The spring support 24 is fastened on the housing base 4 and has a soldering lug 26 projecting outwardly therethrough. Other electrically conductive constructional parts of the snap spring 10 are two stationary contacts 28 and 30, which are fastened opposite each other and each on a contact support 34 and 36, respectively, on both sides of a double sided switching contact 32 fastened on the snap spring 12. The contact supports 34 and 36 are fastened on the housing base 4 and likewise each have a soldering lug 38 and 40 projecting therethrough.

Thus the snap switch 10 connects the soldering lugs 26 and 38 with each other, when the snap spring 12 assumes its first switching position, which in the following is designated as the starting position. The snap switch 10 can be seen in its starting position in FIG. 4 and partially also in FIG. 5*a*. On the other hand, when snap spring 12 assumes its second switching position, designated in the following as the end position, the snap switch 10 connects the soldering lugs 26 and 40 with each other. The snap switch 10 is partially shown in its end position in FIGS. 5*b*, *c* and *d*.

One bearing block 42 is arranged on each side of the spring support 24 integral with the housing 2. In the bearing blocks 42, a lever 50 is pivoted about an axis A parallel to the plane of membrane 8 and almost radial with respect to housing 2. Lever 50 embraces spring support 24 with sufficient clearance, so that it is swivel-adjustable in a wide angular rangs about axis A. To adjust the lever 50, an adjusting member 52 is provided, in the form of a cap screw, which engages the end of the lever 50 remote from axis A and can be screwed into the housing base 4.

The lever 50 has an approximately U-shaped cross section with two flanges 54, which project laterally in a plane parallel to axis A. Two leaf springs 56 are welded to both flanges 54, which extend in the same lengthwise direction as snap spring 12 on either side thereof. While the snap spring 12 extends through between both bearing blocks 42, both leaf springs 56 are arranged outside of the bearing blocks. Each of the two leaf springs 56 are welded to one flange 58 of a guide rod 60, said flanges likewise extending parallel to axis A. Thus, the two leaf springs 56 in common form a support enabling the guide rod 60 to pivot about axis A, but excluding any other movement thereof.

A hook 60 is formed on guide rod 60, on which the one end of snap spring 12, remote from switching contact 32 and from lever 50 is fastened. The end 64 of the guide rod 60 remote from lever 50 itself projects into the recess 66 of the housing wall 6, whose upper and lower limit each form a stop for the guide rod 60. Between the hook 62 and the end 64, a conical point of application 68 is formed on guide rod 60 for an arm 70 of an actuating element 72.

Figure 5A:
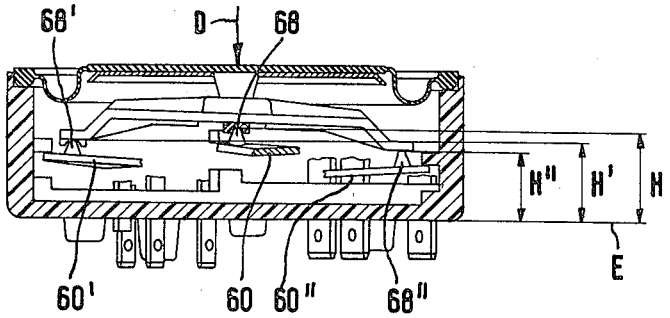
FIGS. 5*a* to 5*d* show the cross section V—V in FIG. 1 in different switching states of the triple pressure switch.
Figure 5B:
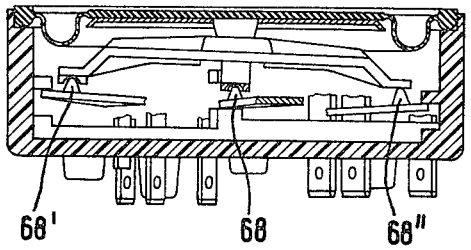
Figure 5C:
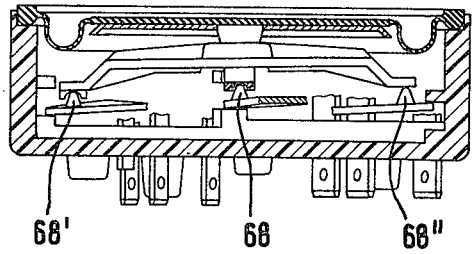
Figure 5D:
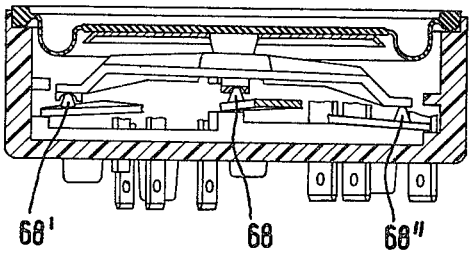

According to whether the adjusting member 52 is screwed in more or less deep into the housing base 4, the end 64 of the guide rod 60 lies in rest position of the snap switch 10 with a more or less large prestress on the upper limit of recess 66 (FIGS. 4 and 5*a*). If however the actuating member 72 exerts with its arm 70 a downward directed force on the point of application 68, which force exceeds a certain amount corresponding to the prestress, then this force presses guide rod 60 into its lower stop position (FIGS. 5*b*, *c* and *d*), and on the way there, the snap spring 12 snaps over abruptly so that its switching contact 32, which, in the starting position lay on the upper stationary contact 28, abruptly releases itself therefrom and lies on the lower stationary contact 30, whereby the end position of snap switch 10 is reached. The snap switch 10 remains in its end position until the force exerted by the arm 70 on the point of application 68 becomes smaller again than the prestress produced by the adjusting member 52 in connection with leaf springs 56.

The actuating member 72 according to FIG. 1 is designed as a three armed lever, and in its middle has a hollow, conical shaped cup 74. A taper plug 76 engages in cup 74, which plug, like cup 74, tapers downwardly, however, with a smaller angle, so that it can tip on all sides within the cup 74. The taper plug 76 is formed on a pressure plate 78, on which the membrane 8 lies.

FIG. 1 shows the housing 2 without membrane 8 and pressure plate 78. The uppermost component parts shown here are the contact supports 34, 34' and 34'' as well as the actuating member 72 with its three arms 70, 70' and 70''. These component parts, which are emphasized in FIG. 1 by thick lines, are omitted in FIG. 2, so that there the snap springs 12,12' and 12'' lie uppermost. The snap springs 12,12' and 12'' emphasized in FIG. 2 with thick lines are omitted in FIG. 3, so that there the levers 50,50' and 50'', the leaf springs 56,56' and 56'' as well as guide rods 60,60' and 60'' are illustrated in all essential details and are emphasized with thick lines. In addition, intermediate walls 80,80' and 80'' are shown with thin lines in FIGS. 1 to 3, which extend essentially radially within the housing 2, and separate the three snap switches 10,10' and 10'' from each other.

Of the three arms 70,70' and 70'' of the actuating member 72, according to FIGS. 5*a* to *d*, arm 70 is designed lug shaped at the bottom of its end pressing on point of application 58, while on the other hand the arm 70' interacting with point of application 68' has on the under side of its end the form of an notch which is approximately radial with respect to its housing 2, while arm 70'' interacting with point of application 68'' is designed evenly on the under side of its end. In this manner, the actuating member 70 is supported free of play on the three points of application 68, 68' and 68'' in a statically well-defined manner.

According to FIG. 5*a*, the points of application 68,68' and 68'' in the original position of the associated snap switches 10, 10' and 10'' lie at a different height over an arbitrarily selected base plane E, which extends normal to the line of application of pressure force D. The point of application 68 of the first snap switch 10 has the greatest height H over the base plane E. The point of application 68' of the second snap switch 10' has the second greatest height H', and the point of application 68'' of the third snap switch 10'' has the lowest height H''. With the snapping over of the first snap switch 10, however, the height relationships change according to FIG. 5*b* in such a way that now the point of application 68 assumes a height position, which lies between heights H' and H''. Corresponding height changes take place when according to FIG. 5*c* the second snap switch 10' and according to FIG. 5*d* the third snap switch 10'' snaps over from its starting position into its end position.

What is claimed is:

1. A multiple pressure switch comprising an actuating member and a first and a second snap spring, said snap springs each having at least one electrical contact, said contacts each cooperating with a fixed electrical contact, said snap springs under spring prestress each assume a starting position, and have a first and second point of application, respectively, for said actuating member, the actuating member being additionally supported on a third point of application, said three points of application lying on the corners of a conceived triangle and with a gradual increase of an external force acting within the triangle on the actuating member, the actuating member causes first the first and then the second snap switch to snap over into an end position, wherein relative to a base plane E normal to the direction of application of said external force, said first point of application in its starting position lies higher and in its end position lies deeper than said second point of application in its original position, and the second point of application in its starting position lies higher and in its end position lies lower than the third point of application.

2. The multiple pressure switch as claimed in claim 1, wherein said second point of application in its starting position lies at half height between the starting and end position of said first point of application.

3. The multiple pressure switch as claimed in claim 1 or claim 2, wherein said first point of application in its end position lies at half height between the starting and end position of said second point of application.

4. The multiple pressure switch as claimed in claim 1 further having a third snap switch on which said third point of application for said actuating member is formed, and which, with gradual increase of said external force, snaps over after the second snap switch, wherein said third point of application in its end position lies deeper than said second point of application in its end position.

5. The multiple pressure switch as claimed in claim 4, wherein said second point of application in its end position lies at half height between the starting and end position of said third point of application.

* * * * *